US007172484B2

(12) United States Patent
Thai

(10) Patent No.: US 7,172,484 B2
(45) **Date of Patent: *Feb. 6, 2007**

(54) BUBBLE MACHINE

(75) Inventor: Douglas Thai, Walnut, CA (US)

(73) Assignee: Arko Development Ltd., Hong Kong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 11/037,483

(22) Filed: Jan. 18, 2005

(65) Prior Publication Data

US 2006/0052027 A1 Mar. 9, 2006

Related U.S. Application Data

(63) Continuation-in-part of application No. 10/936,174, filed on Sep. 8, 2004.

(51) Int. Cl.
*A63H 33/28* (2006.01)

(52) U.S. Cl. ..... 446/15; 446/16; 446/21

(58) Field of Classification Search ..... 446/15–21
See application file for complete search history.

(56) References Cited

U.S. PATENT DOCUMENTS

| | | | | |
|---|---|---|---|---|
| 430,095 | A | 6/1890 | Thain | |
| 616,239 | A | 12/1898 | King | |
| 654,642 | A * | 7/1900 | James | 446/19 |
| 2,041,423 | A | 5/1936 | Mausolf | |
| 2,213,391 | A | 9/1940 | Gamble | |
| 2,225,702 | A | 12/1940 | Lyon, Jr. | |
| 2,396,433 | A | 3/1946 | Pimblett | |
| 2,527,935 | A | 10/1950 | Joel, II. | |
| 2,547,825 | A | 4/1951 | King | |
| 2,560,582 | A | 7/1951 | Limber | |
| 2,587,537 | A | 2/1952 | Scott | |
| 2,606,396 | A | 8/1952 | Hill | |
| 2,632,281 | A | 3/1953 | Schmidt, Jr. | |
| 2,659,177 | A | 11/1953 | Kopf | |
| 2,700,845 | A | 2/1955 | Arliss | |
| 2,711,051 | A | 6/1955 | Pick | |
| 2,736,988 | A | 3/1956 | Fisher | |
| 2,974,438 | A | 3/1961 | Hopkins | |
| 2,987,847 | A | 6/1961 | Jones | |
| 3,064,387 | A * | 11/1962 | Campbell | 446/21 |
| 3,071,888 | A | 1/1963 | Knott | |
| 3,100,947 | A | 8/1963 | Hellman | |
| 3,109,255 | A | 11/1963 | Hein | |
| 3,183,621 | A | 5/1965 | Allen, Jr. | |
| 3,228,136 | A | 1/1966 | Rouse | |
| 3,323,250 | A | 6/1967 | Gibbons | |
| 3,420,412 | A | 1/1969 | Greene | |
| 3,579,898 | A | 5/1971 | Hein | |
| 3,601,313 | A | 8/1971 | Berg | |
| 3,604,144 | A | 9/1971 | Span | |

(Continued)

FOREIGN PATENT DOCUMENTS

| | | | |
|---|---|---|---|
| GB | 2224951 | A * | 5/1990 |

*Primary Examiner*—Bena Miller
(74) *Attorney, Agent, or Firm*—Raymond Sun

(57) ABSTRACT

A bubble machine has a housing, a bubble generator positioned adjacent the front opening of the housing, a fan positioned inside the housing, and a motor positioned inside the housing and operatively coupled to the fan and the bubble generator. Actuation of the motor causes the fan and the bubble generator to be simultaneously actuated.

22 Claims, 10 Drawing Sheets

U.S. PATENT DOCUMENTS 3,731,412 A 5/1973 Winslow
3,736,694 A 6/1973 Lebensfeld
3,845,583 A 11/1974 Ziff
3,913,260 A 10/1975 Corbett
3,925,923 A 12/1975 La Fata et al.
3,952,447 A 4/1976 Hackell
4,044,496 A 8/1977 Jernstrom
4,246,717 A 1/1981 Wachtel
D263,062 S 2/1982 Rasmussen
4,423,565 A 1/1984 Bart
4,438,955 A 3/1984 Ryan
4,467,552 A 8/1984 Jernigan
4,481,731 A 11/1984 La Fata et al.
4,603,021 A 7/1986 Urso
4,700,965 A 10/1987 Kinberg
4,764,141 A 8/1988 D'Andrade
4,775,348 A 10/1988 Collins
4,804,346 A 2/1989 Sheng
RE32,973 E 7/1989 Panzarella
4,871,173 A * 10/1989 Lammertink ..... 273/153 S
D304,466 S 11/1989 Glickman
4,957,464 A 9/1990 Perez
4,988,319 A 1/1991 Sheng
5,035,665 A * 7/1991 Sheng ..... 446/15
5,135,225 A * 8/1992 Pszotka et al. ..... 273/153 S
5,230,648 A 7/1993 Kelly et al.
5,234,129 A 8/1993 Lau
5,395,274 A 3/1995 Myers
5,419,728 A * 5/1995 Dallara ..... 446/15
5,462,469 A 10/1995 Lei
5,498,191 A 3/1996 DeMars
5,520,564 A 5/1996 DeMars
5,542,869 A 8/1996 Petty
5,613,890 A 3/1997 DeMars
5,628,512 A * 5/1997 Chan ..... 273/153 S
5,695,379 A 12/1997 Ho
5,832,969 A 11/1998 Schramm
5,842,899 A 12/1998 Cernansky et al.
5,850,945 A 12/1998 Frankel
5,879,218 A 3/1999 Tao
5,890,942 A 4/1999 Souza-Ferreira et al.
6,003,868 A * 12/1999 Unsicker ..... 273/153 S
6,062,935 A 5/2000 Gross
6,102,764 A 8/2000 Thai
6,139,391 A 10/2000 Thai
6,149,486 A 11/2000 Thai
6,200,184 B1 3/2001 Rich et al.
6,315,627 B1 11/2001 Thai
6,331,130 B1 12/2001 Thai
6,416,377 B1 7/2002 Bart
6,544,091 B1 4/2003 Thai
6,547,622 B2 4/2003 Thai
6,620,016 B1 9/2003 Thai
6,659,830 B2 12/2003 Thai
6,786,251 B2 9/2004 Nadel et al.

* cited by examiner

BUBBLE MACHINE

RELATED CASES

This is a continuation-in-part of application Ser. No. 10/936,174, filed Sep. 8, 2004, whose entire disclosure is incorporated by this reference as though set forth in full herein.

BACKGROUND OF THE INVENTION

1. Field of the Invention

The present invention relates to bubble toys, and in particular, to a bubble generating machine which automatically generates numerous bubbles at the same time.

2. Description of the Prior Art

Bubble producing toys are very popular among children who enjoy producing bubbles of different shapes and sizes. Many bubble producing toys have previously been provided. Perhaps the simplest example has a stick with a circular opening or ring at one end, resembling a wand. A bubble solution film is produced when the ring is dipped into a dish that holds bubble solution or bubble producing fluid (such as soap) and then removed therefrom. Bubbles are then formed by blowing carefully against the film. Such a toy requires dipping every time a bubble is to created, and the bubble solution must accompany the wand from one location to another.

Recently, the market has provided a number of different bubble generating assemblies that are capable of producing a plurality of bubbles. Examples of such assemblies are illustrated in U.S. Pat. No. 6,149,486 (Thai), U.S. Pat. No. 6,331,130 (Thai) and U.S. Pat. No. 6,200,184 (Rich et al.). The bubble rings in the bubble generating assemblies in U.S. Pat. No. 6,149,486 (Thai), U.S. Pat. No. 6,331,130 (Thai) and U.S. Pat. No. 6,200,184 (Rich et al.) need to be dipped into a dish that holds bubble solution to produce films of bubble solution across the rings. The motors in these assemblies are then actuated to generate air against the films to produce bubbles.

All of these aforementioned bubble generating assemblies require that one or more bubble rings be dipped into a dish of bubble solution. In particular, the child must initially pour bubble solution into the dish, then replenish the solution in the dish as the solution is being used up. After play has been completed, the child must then pour the remaining solution from the dish back into the original bubble solution container. Unfortunately, this continuous pouring and re-pouring of bubble solution from the bottle to the dish, and from the dish back to the bottle, often results in unintended spillage, which can be messy, dirty, and a waste of bubble solution.

Thus, there remains a need to provide an apparatus for automatically generating multiple bubbles without the need for a user to repeatedly dip the bubble ring into a dish of bubble solution.

SUMMARY OF THE DISCLOSURE

It is an object of the present invention to provide an apparatus for generating multiple bubbles in a convenient and clean manner.

It is another object of the present invention to provide an apparatus for generating multiple bubbles at the same time.

The objectives of the present invention are accomplished by providing a bubble machine having a housing, a bubble generator positioned adjacent the front opening of the housing, a fan positioned inside the housing, and a motor positioned inside the housing and operatively coupled to the fan and the bubble generator. Actuation of the motor causes the fan and the bubble generator to be simultaneously actuated.

The present invention also provides a bubble generator having an outer loop and a plurality of separate and spaced-apart sections positioned along the outer loop. The sections include a first section has a first bubble ring that is positioned inside a second larger bubble ring, and a second section having a third bubble ring.

The present invention further provides a method of generating a bubble that encloses a smaller bubble inside. The method first provides a first bubble ring that is positioned inside a second larger bubble ring, and then moves the first and second bubble rings together in a manner where:

(i) a first portion of the second bubble ring first passes in front of an air generator;

(ii) the first bubble ring completely passes in front of the air generator while a second portion of the second bubble ring is also passing in front of the air generator; and (iii) a third portion of the second bubble ring passes in front of an air generator.

DETAILED DESCRIPTION OF THE PREFERRED EMBODIMENTS

Figure 1:
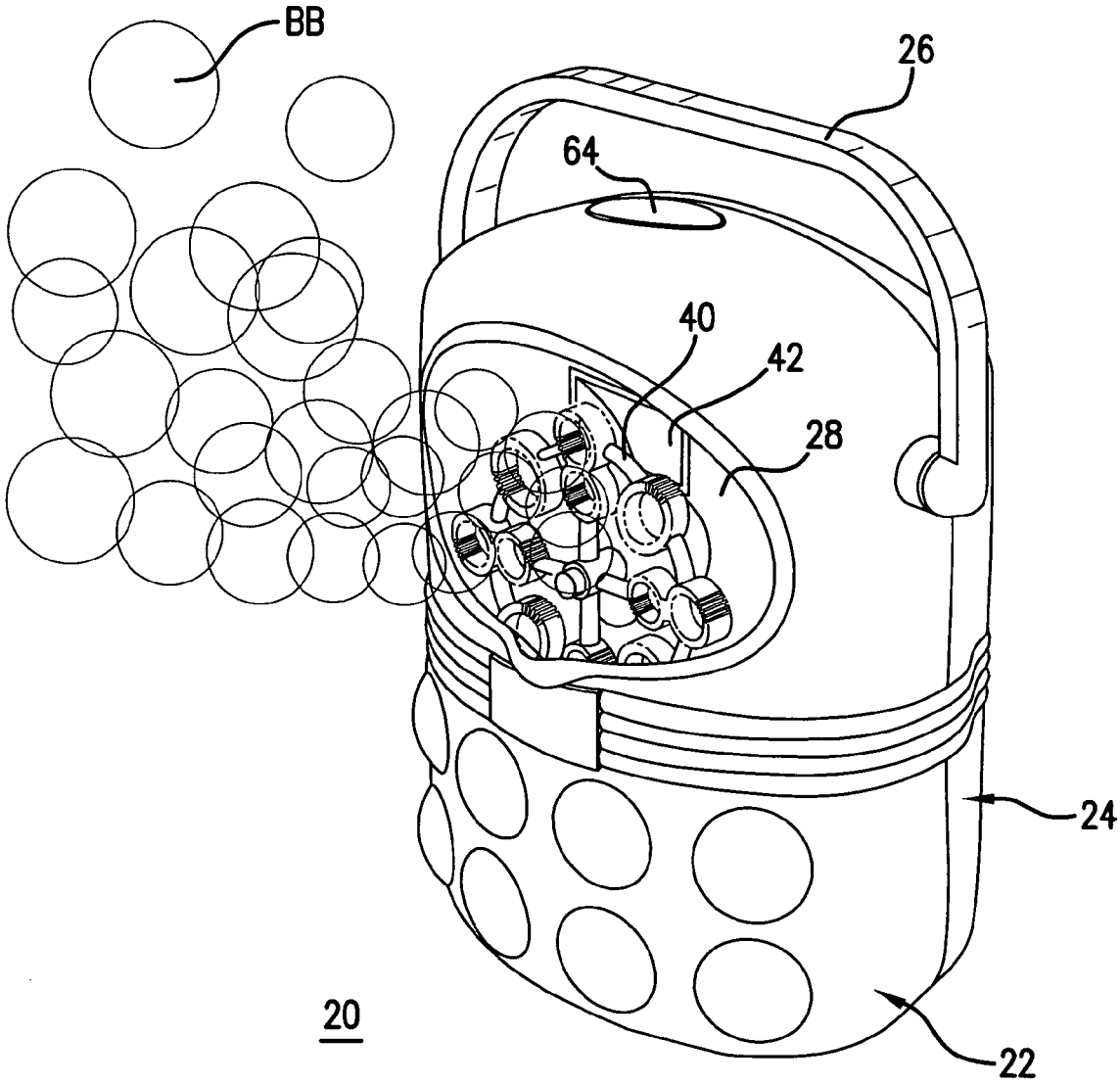
FIG. 1 is a perspective view of a bubble machine according to one embodiment of the present invention.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

FIGS. 1–11D illustrate one embodiment of a bubble machine 20 according to the present invention. The machine 20 has a housing that is made up of a front housing frame 22 and a rear housing frame 24 that are connected together by, for example, screws or welding or glue. These frames 22, 24 together define a hollow interior for housing the internal components of the machine 20, as described below. A pivotable handle 26 is secured to one of the frames 22, 24.

Figure 2:
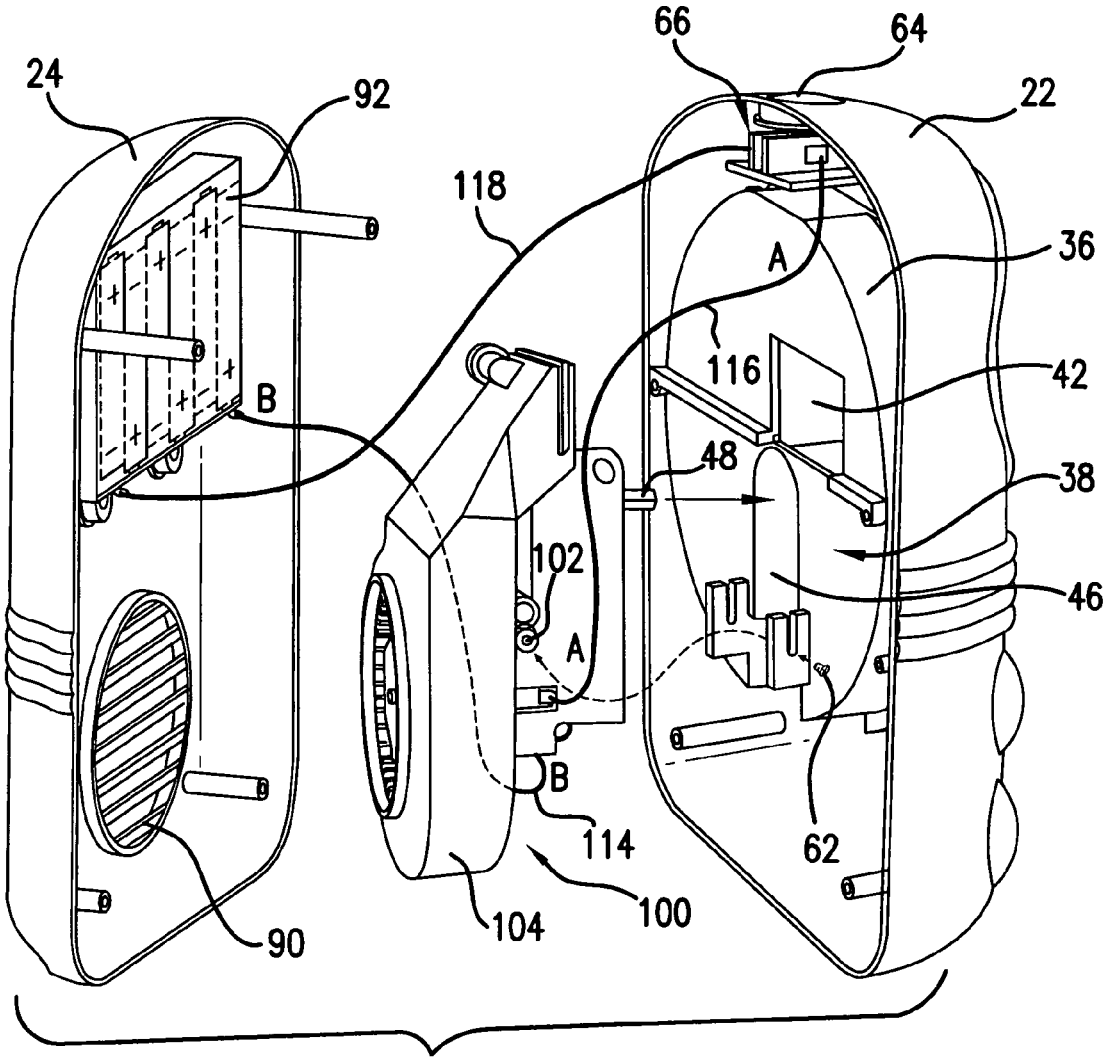
FIG. 2 is an exploded perspective view of the machine of FIG. 1.
Figure 4:
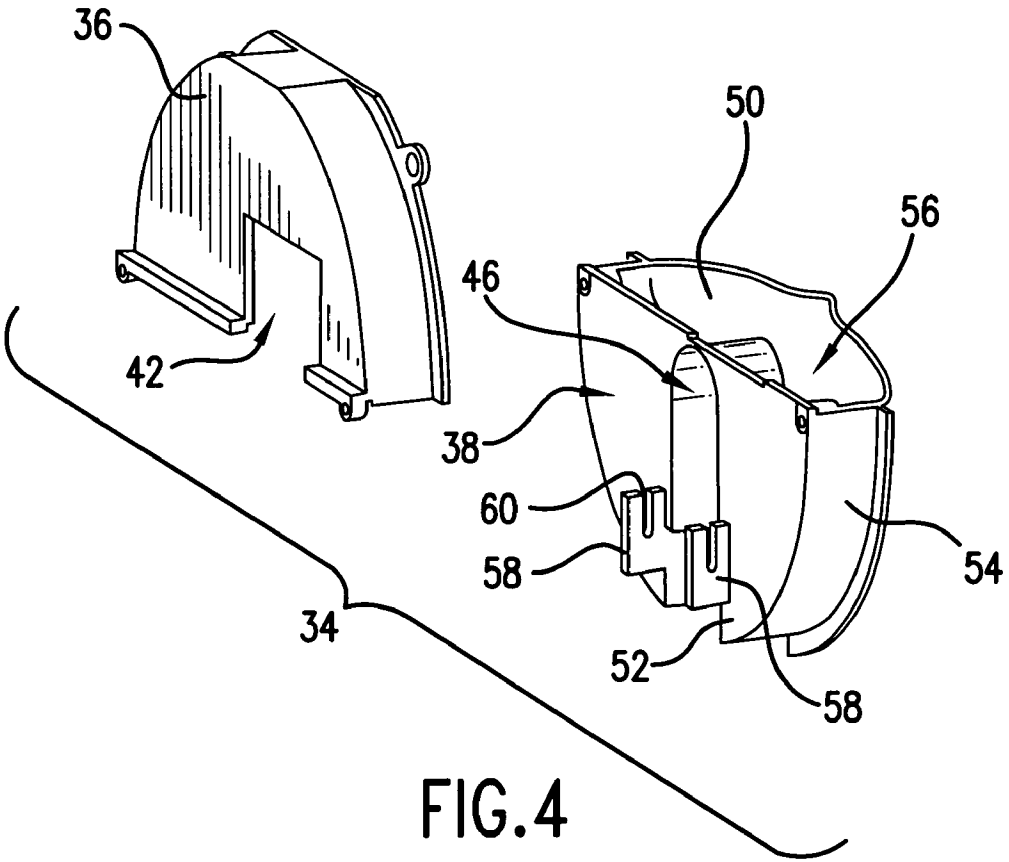
FIG. 4 is an exploded perspective view of the bubble generator housing of the machine of FIG. 1.
Figure 3:
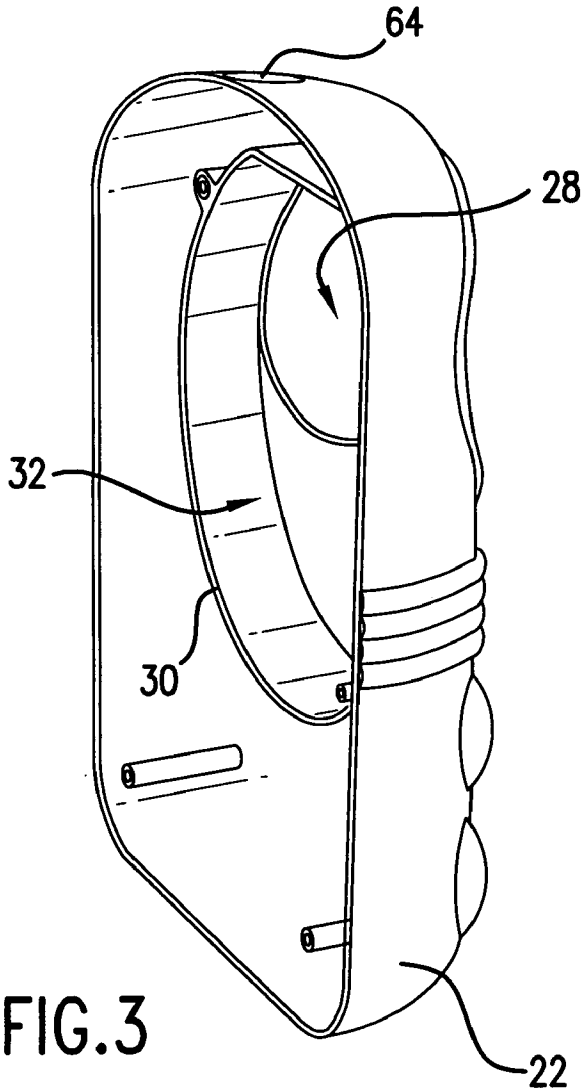
FIG. 3 is a rear perspective view of the front housing frame of the machine of FIG. 1.

The front housing frame 22 has a front opening 28 through which generated bubbles BB can be released. Referring to FIGS. 2–4, a receiving wall 30 is provided on the inner side of the front housing frame and defines a receiving space 32 that receives a bubble generator housing 34. The bubble generator housing 34 is comprised of an upper shell 36 and a lower shell 38 that are coupled together to receive the bubble generator 40, as described in greater detail below. The upper shell 36 has an air opening 42 which allows air generated by an air generator (e.g., fan) 44 to pass. The lower shell 38 has a cut-away section 46 for receiving a drive shaft 48 that is adapted to be connected to a hub 70 of the bubble generator 40 (see FIGS. 6 and 9). The lower shell 38 has a front wall 50 and a rear wall 52 connected together by side walls 54 so as to define a reservoir 56 that holds bubble solution. Two extensions 58 extend from the rear wall 52, with each extension 58 having a groove 60 that is adapted to receive a connecting screw 62 therethrough.

An on/off switch 64 is provided at the top of the front housing frame 22. A switch assembly 66 is provided adjacent the switch 64 inside the front housing frame 22, and is operatively coupled to the switch 64 in the manner described in connection with FIGS. 10 and 11A–11D below.

Figure 5:
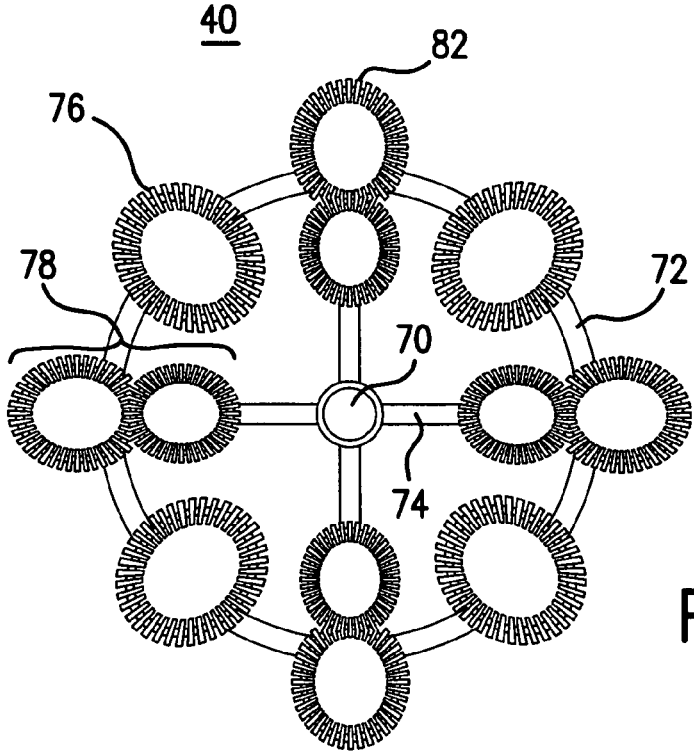
FIG. 5 ilustrates a bubble generator according to one embodiment of the present invention.

The bubble generator 40 is illustrated in FIG. 5, and has a central hub 70 that is connected to a segmented outer loop 72 by a plurality of spokes 74. A plurality of separate sections are provided, with each section has one or more bubble rings that are attached in spaced-apart manner to the outer loop 72 and the spokes 74. Two types of bubble rings can be provided in this embodiment, individual bubble rings 76 in a given section, and sets of double bubble rings 78 in other sections. The double rings 78 can have different shapes and sizes. Each of the bubble rings 76, 78 has a generally annular body that defines an opening (which can be greater than one inch in diameter) that allows air to pass unimpeded therethrough. The annular body can have a certain thickness so that it becomes somewhat cylindrical. The outer loop 72 is segmented because the outer loop 72 does not extend through the opening of any of the bubble rings 76, 78. The body of each bubble ring 76, 78 is serrated such that ridges or bumps 82 are provided on the body. The ridges 82 function to hold the bubble solution against the body to form a solution film that is blown to form the bubble. The body can have any desired shape, such as circular (as shown), oval, square, rectangular, etc. The individual bubble rings 76 and sets of double bubble rings 78 can be provided in any manner along the outer ring 72 and the spokes 74, although FIG. 5 illustrates them being provided in alternating fashion.

Figure 6:
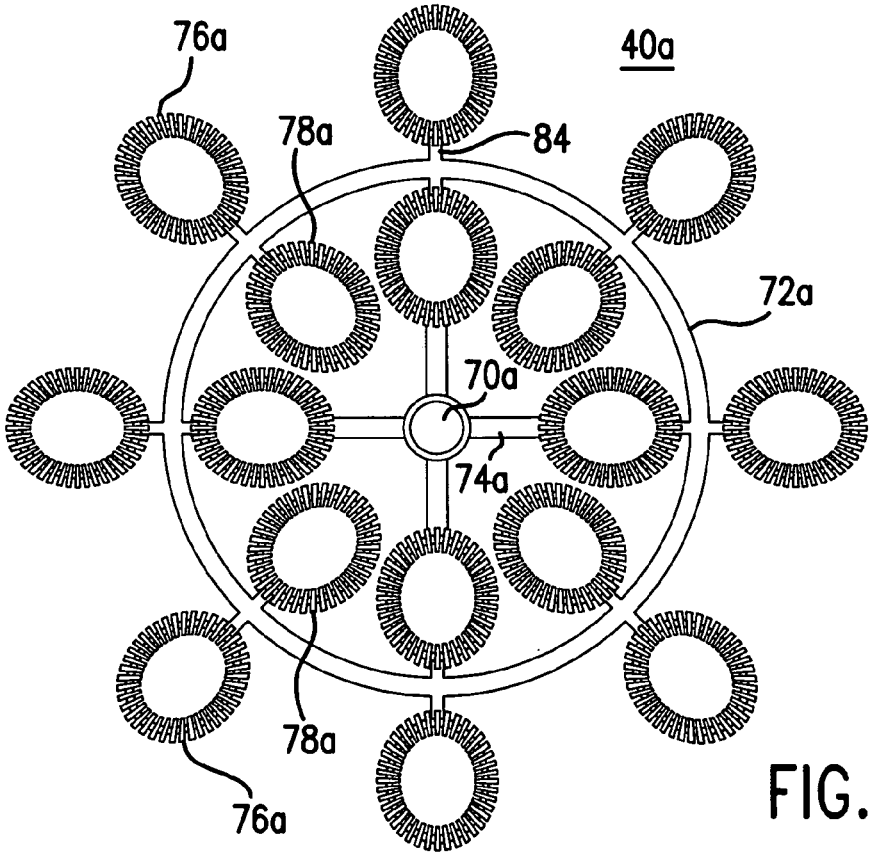
FIG. 6 ilustrates a bubble generator according to another embodiment of the present invention.
Figure 8:
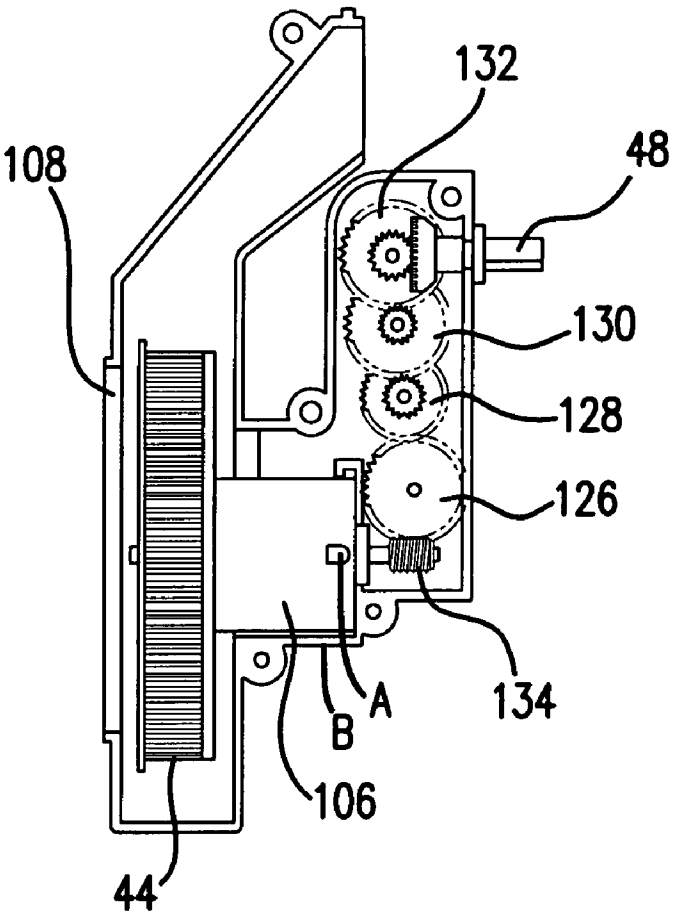
FIG. 8 is a cross-sectional view of the engine of FIG. 7.
Figure 7:
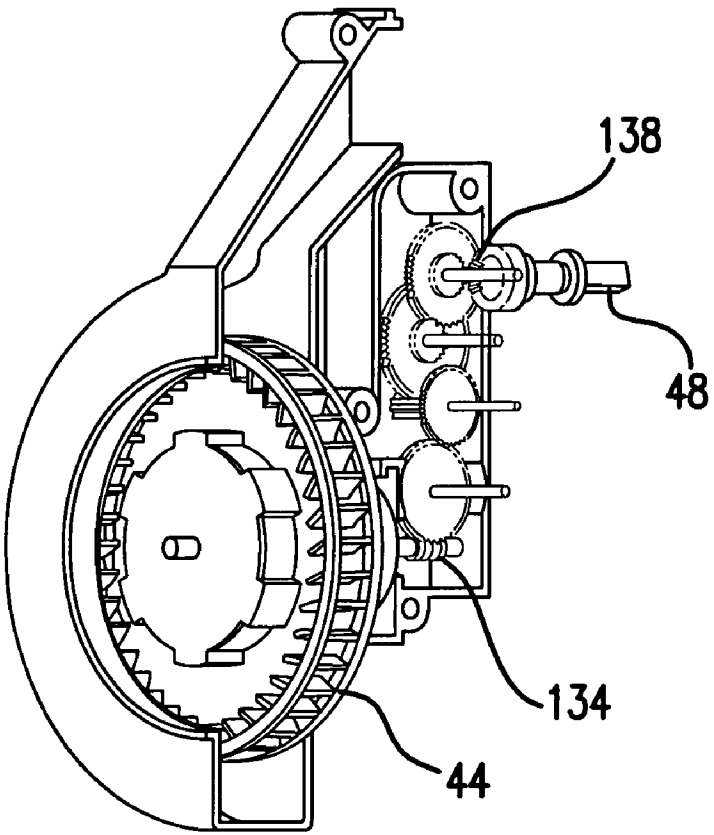
FIG. 7 is a perspective sectional view of the engine of the bubble machine of FIG. 1.
Figure 9:
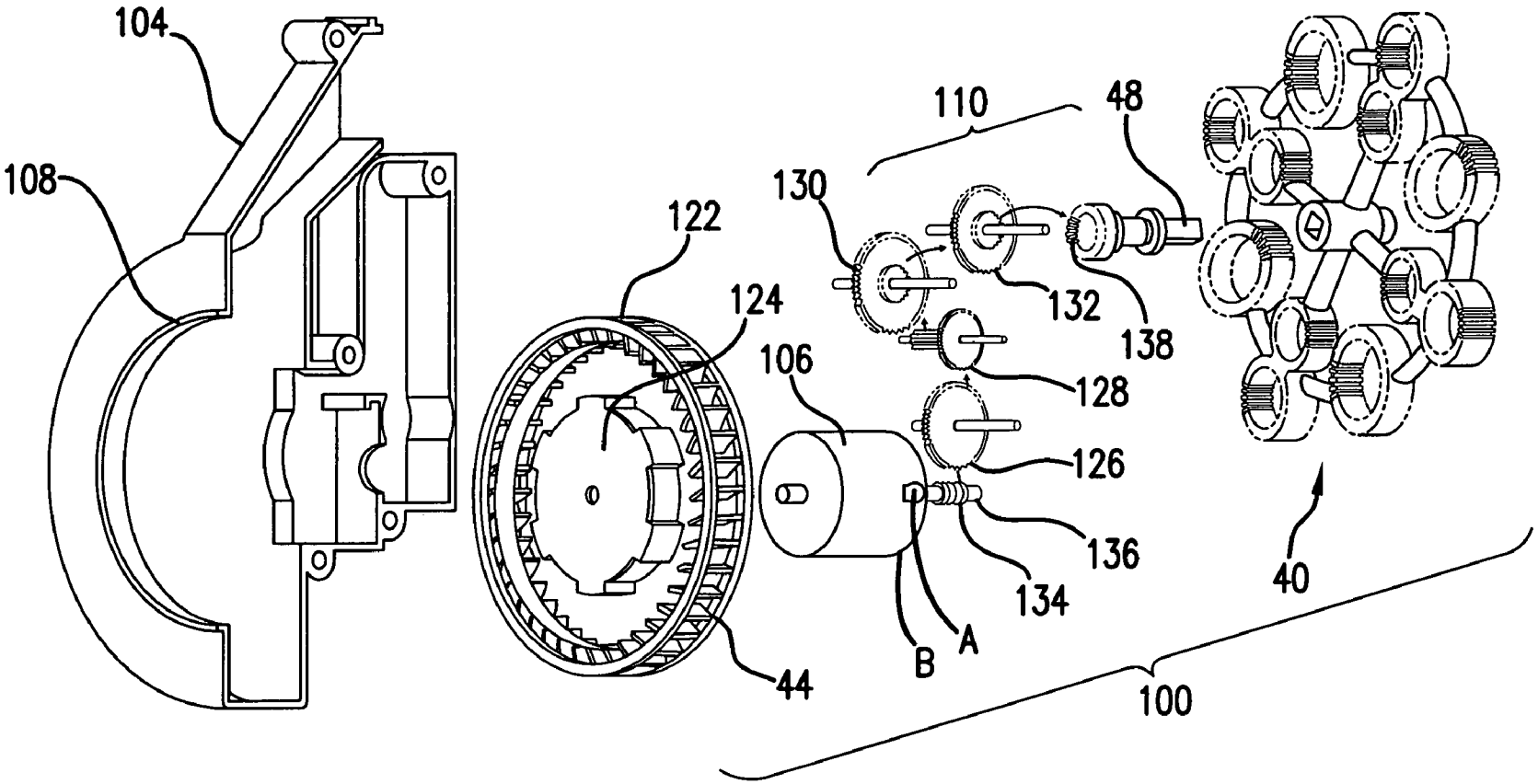
FIG. 9 is an exploded perspective view of the engine of FIG. 7.

FIG. 6 illustrates another bubble generator 40*a* according to the present invention. The bubble generator 40*a* is similar to the bubble generator 40, and also has a central hub 70*a* that is connected to a non-segmented outer loop 72*a* by a plurality of spokes 74*a*. A plurality of separate sections are provided, with each section having a plurality of bubble rings 76*a*, 78*a* that are attached in spaced-apart manner to the outer loop 72*a* and the spokes 74*a*. Each bubble ring 76*a*, 78*a* of each section is attached on opposite sides of the outer loop 72*a*, in a manner opposing each other, via branches 84. Thus, the bubble rings 76*a*, 78*a* at a given section are positioned one on top of the other when the section is aligned vertically. Some of the bubble rings 78*a* can be attached directly to a spoke 74*a*. Each of the bubble rings 76*a*, 78*a* can have the same construction as the bubble rings 76, 78 described above.

Figure 13A:
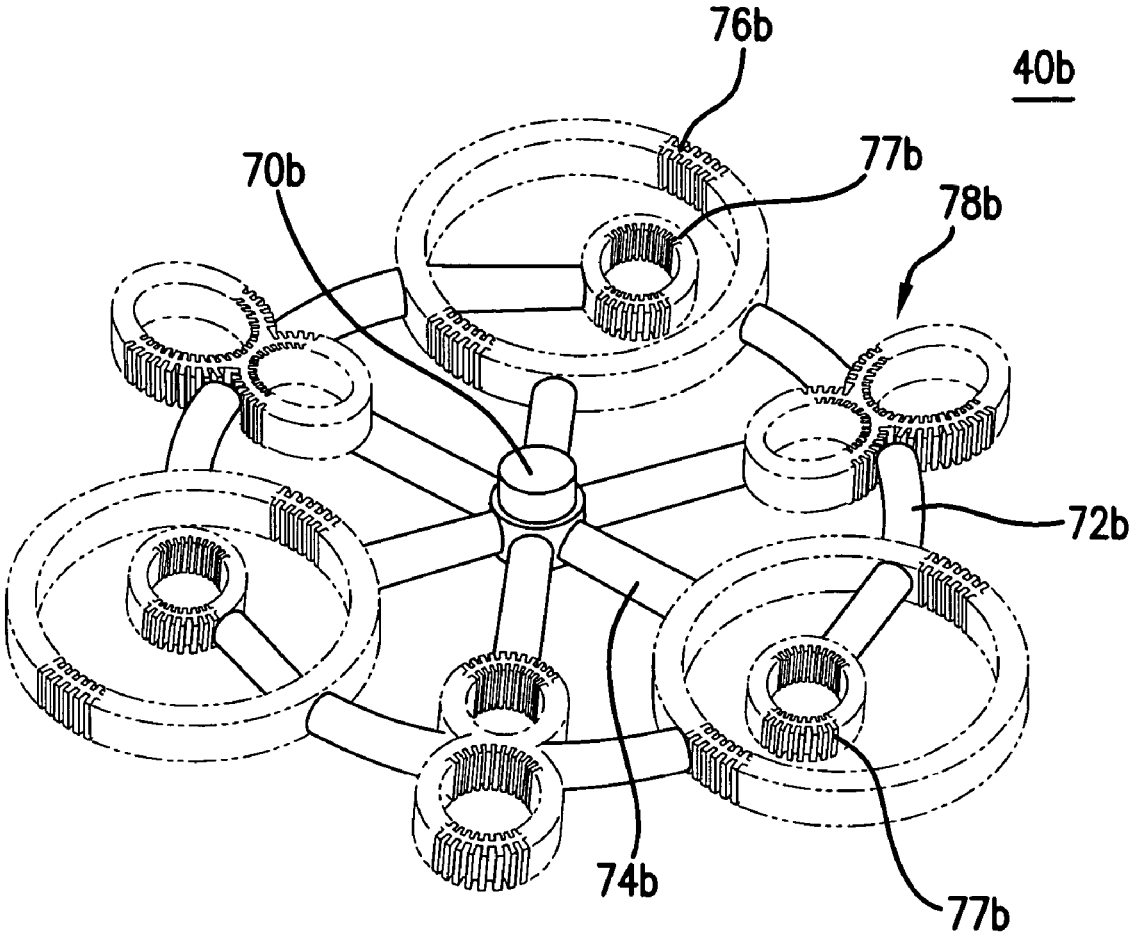
FIG. 13A is a perspective view of a bubble generator according to another embodiment of the present invention.
Figure 13B:
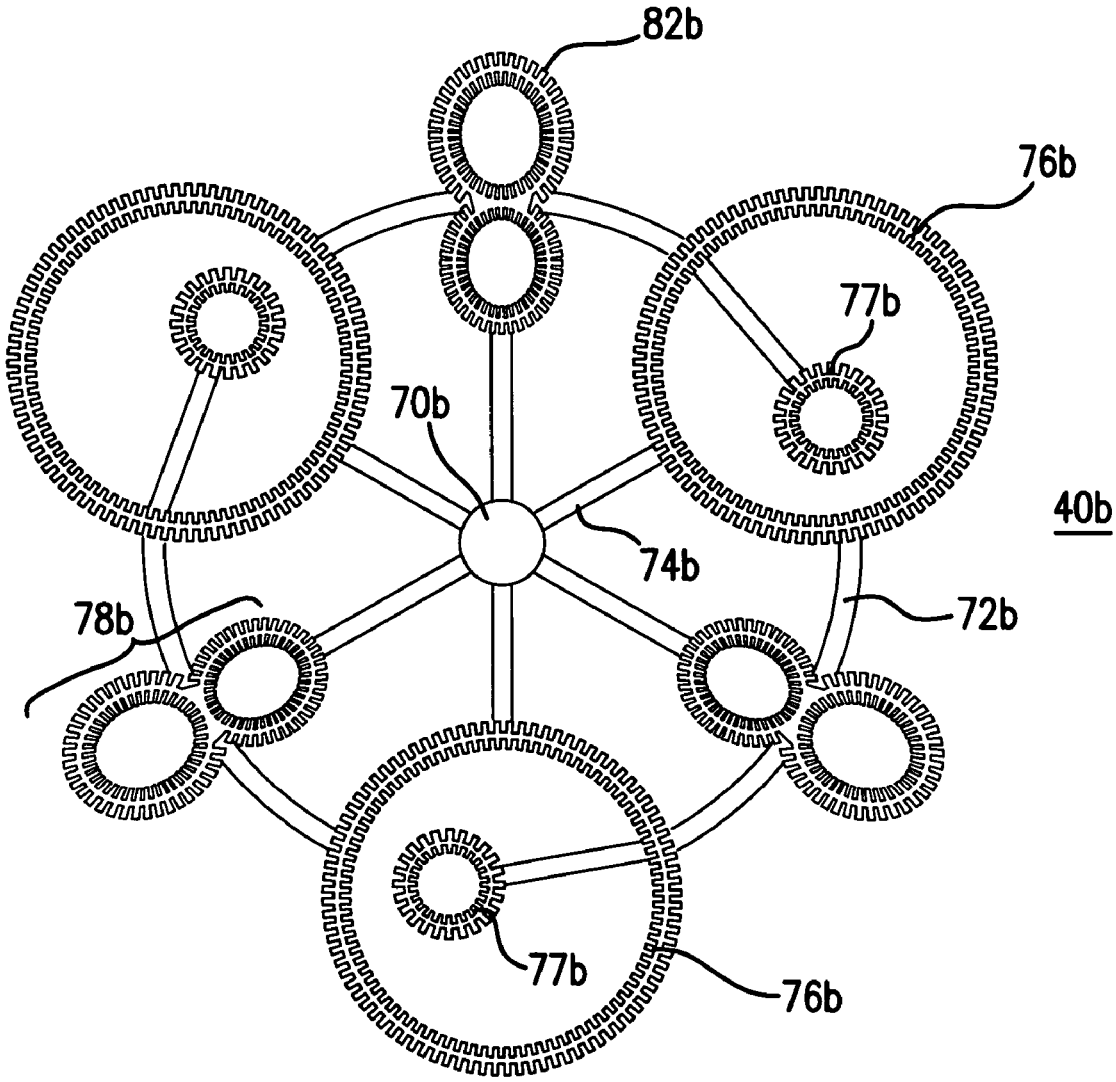
FIG. 13B is a top plan view of the bubble generator of FIG. 13A.

FIGS. 13A and 13B illustrate another bubble generator 40*b* according to the present invention. The bubble generator 40*b* is similar to the bubble generator 40, and also has a central hub 70*b* that is connected to a non-segmented outer loop 72*b* by a plurality of spokes 74*b*. In addition, two types of bubble rings are also provided in this embodiment, with individual bubble rings 76*b* in a given section, and sets of double bubble rings 78*b* in other sections. The double rings 78*b* can be the same as the double rings 78 in FIG. 5. Each individual bubble ring 76*b* further includes at least one smaller bubble ring 77*b* positioned inside the bubble ring 76*b* and aligned in the same plane as the bubble ring 76*b*. The smaller bubble ring 77*b* can be supported by a portion of the segmented outer loop 72*b*. The body of each bubble ring 76*b*, 77*b*, 78*b* can also be serrated such that ridges or bumps 82*b* are provided on the body. The individual bubble rings 76*b*, the smaller bubble rings 77*b*, and sets of double bubble rings 78*b* can be provided in any manner along the outer ring 72*b* and the spokes 74*b*, although FIGS. 13A and 13B illustrate them being provided in alternating fashion.

The rear housing frame 24 has a grilled opening 90 that allows air to be received into the housing. A power source 92 (which can include a plurality of conventional batteries) is secured to the rear housing frame 24.

Referring to FIG. 2, an engine 100 is retained inside the hollow interior of the machine housing between the housing frames 22, 24, and can be secured to one of the housing frames 22, 24. In this embodiment, the engine is illustrated as being secured to the front housing frame 22 by screws 62 that extend through corresponding grooves 60 in the extensions 58 to be threadably secured to screw holes 102 in the engine housing 104. Referring now to FIGS. 2 and 7–9, the engine 100 includes a motor 106, an air generator (e.g., fan) 44, and a gear system 110 that are all housed inside the engine housing 104. The fan 44 and the gear system 110 are both operatively coupled to the motor 106 so that the motor 106 can simultaneously drive both the fan 44 and the gear system 110. The fan 44 is coupled to one end of the motor 106 and is positioned adjacent an opening 108 of the engine housing 104, which is in turn positioned adjacent the grilled opening 90, so that the fan 44 can circulate the air received through the grilled opening 90 inside the machine housing. The gear system 110 is coupled to another end of the motor 106 and the drive shaft 48, so as to rotate the drive shaft 48 and the bubble generator 40 that is connected at the end of the drive shaft 48.

The motor 106 is electrically coupled to the power source 92 via a first wire 114, a second wire 116 couples an electrical contact 117 of the switch assembly 66 and the motor 106, and a third wire 118 couples the power source 92 to an electrical contact 120 of the switch assembly 66, which is adapted to releasably contact the other electrical contact 117 to form a closed electrical circuit.

The fan 44 has a plurality of blades 122 that are spaced apart around a hub 124. The gear system 110 has a plurality of gears 126, 128, 130, 132 that are operatively coupled to a worm gear 134 that is carried on a shaft 136 of the motor 106, and a worm gear 138 that is provided at an inner end of the drive shaft 48.

Figures 10, 11A, 11B, 11C, 11D, 12:
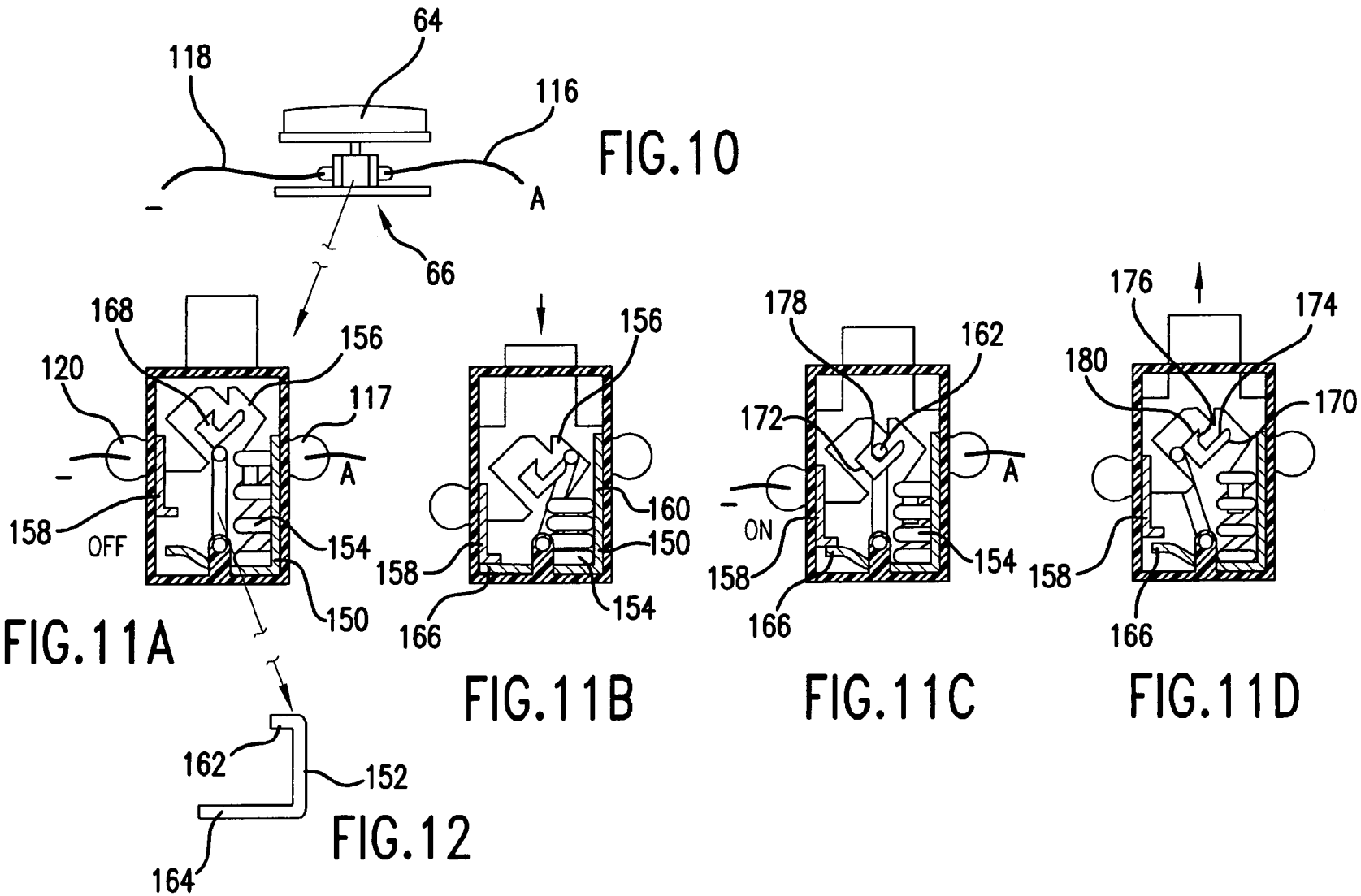
FIG. 10 illustrates the switch and switch assembly of the machine of FIG. 1.
FIGS. 11A–11D illustrate the operation of the switch assembly of the machine of FIG. 1.
FIG. 12 is a side plan view of the hook member of the switch assembly of the machine of FIG. 1.

Referring to FIGS. 10–11D, the switch assembly 66 has a housing 150 with the electrical contact 117 fixedly secured to one side of the housing 150, and with the electrical contact 120 movably attached to another side of the housing 150. The housing 150 retains therein a hook member 152 (see also FIG. 12), a biasing member 154, a sliding plate 156, an electrical connector 158 that is secured to the contact 120, and another electrical connector 160 that is secured to the contact 117. The hook member 152 is a generally L-shaped member having an upper hooked end 162 and a lower end 164 that is pivotably secured to the housing 150. The biasing member 154 can be a spring, and is positioned in the housing 150 and secured with the sliding plate 156 so that the biasing member 154 normally biases the sliding plate 156 upwardly. The electrical connector 158 is connected to the contact 120 and the sliding plate 156, so that the electrical connector 158 (and its contact 120 on the outside of the housing 150) is slid downwardly when the sliding plate 156 is pushed downwardly. Similarly, the electrical connector 158 (and its contact 120 on the outside of the housing 150) is biased upwardly when the sliding plate 156 is biased upwardly by the biasing member 154. The electrical connector 160 is fixedly connected to the contact 117, and has a tail 166 that is positioned to be releasably engaged with the electrical connector 158. FIGS. 11A and 11D show the connectors 158, 160 disengaged, so that the electrical circuit is opened, and FIGS. 11B and 11C show the connectors 158, 160 engaged to form a closed electrical circuit.

The sliding plate 156 has a guide member 168. The guide member 168 has two angled outside surfaces 170, 172 that are connected to form an outer V-shaped configuration. The guide member 168 also has two angled inner surfaces 174, 176 that are connected to form an inner V-shaped configuration, with the angled inner surface 176 having a corner edge 178. A further angled surface 180 connects the corner edge 178 and the top of the angled surface 172.

The guide member 168 is adapted to releasably engage the hook member 152 so as to open and close the electrical circuit. This is best illustrated in FIGS. 11A–11D as follows. When the switch assembly 66 is in the normal "off" position as shown in FIG. 11A, the biasing member 154 normally biases the sliding plate 156 upwardly, so that the connector 158 is disengaged from the connector 160. In this position, the hooked end 162 of the hook member 152 is positioned adjacent the bottom of the surface 170. When the user presses once on the switch 64 (see FIG. 11B), the electrical circuit will be closed to turn on the machine 20. Specifically, pressing the switch 64 will also push the sliding plate 156 downwardly, which concurrently pushes the connector 158 downwardly until it engages the tail 166 of the other connector 160 to close the electrical circuit. As the sliding plate 156 is pushed downwardly, the hooked end 162 slides upwardly along the angled surface 170 as the hook member 152 is pivoted sideways. Eventually, the hooked end 162 will reach the top of the surface 170 and slide downwardly along the angled surface 174 until the hooked end 162 is seated at the bottom of the angled surfaces 174 and 176, as shown in FIG. 11C. In this position, the hooked end 162 engages the guide member 168 to maintain the sliding plate 156 (and the connector 158) in a downward position against the bias of the biasing member 154, so that the connectors 158, 160 are constantly engaged, thereby keeping the electrical circuit closed. In addition, the corner edge 178 prevents the hooked end 162 from sliding past the top of the angled surface 176.

When the user presses the switch 64 again, the electrical circuit will be opened to turn off the machine 20. See FIG. 11D. Specifically, pressing the switch 64 in the position of FIG. 11C will cause the hooked end 162 to travel upwardly along the angled surface 176, over the corner edge 178, and downwardly along the angled surface 180. This causes the hooked end 162 to disengage the guide member 168, which allows the biasing member 154 to normally bias the sliding plate 156 (and the connector 158) upwardly to disengage the contact between the connectors 158, 160, thereby opening the electrical circuit.

The operation of the bubble machine 20 will now be described. First, the user can introduce bubble solution into the reservoir 56 via the front opening 28. Some of the bubble rings 76 and 78 of the bubble generator 40 are always positioned inside the reservoir 56 (see FIGS. 1, 3 and 4), and are therefore dipped inside the bubble solution. When a bubble ring 76, 78 is dipped in the bubble solution, a thin film of bubble solution will be formed that extends across the opening of each bubble ring 76, 78. The ridges 82 are effective in maintaining the film of bubble solution against the bubble ring 76, 78.

When the user wishes to turn on the bubble machine 20, the user merely presses the switch 64 a first time. This closes the electrical circuit in the manner described above in connection with FIGS. 10 and 11A–11D, thereby powering the motor 106. The motor 106 will simultaneously (i) cause the fan 44 to rotate (thereby generating a stream of air that will be blown through the air opening 42), and (ii) will drive the gear system 110 to rotate the bubble generator 40. As the bubble generator 40 rotates, the bubble rings 76, 78 will pass in front of the air opening 42 so that the air generated by the fan 44 will be directed through the opening of each bubble ring 76, 78 and the film of bubble solution extending there-across. The air that is directed at the films of bubble solution will create a plurality of bubbles BB as shown in FIG. 1. In this position, the bubble machine 20 will continue to generate a plurality of continuous streams of bubbles BB. In this regard, the provision of the sets of double bubble rings 78 and 76*a*+78*a* allows the machine 20 to produce two or more streams of continuous bubbles BB.

The bubble generator 40*b* in FIGS. 13A and 13B is slightly different from the other bubble generators 40 and 40*a* because the bubble generator 40*b*, in addition to generating small and big bubbles, also generates smaller bubbles inside larger bubbles. See FIG. 14. This effect of creating smaller bubbles inside larger bubbles is accomplished by positioning the smaller rings 77*b* inside the larger rings 76*b*. In particular, as the bubble generator 40*b* rotates, a leading edge of the larger ring 76*b* moves in front of the fan 44 first, thereby beginning the generation of a larger bubble. As this larger bubble is being generated by the larger ring 76*b*, the entire smaller ring 77*b* inside the larger ring 76*b* will move in front of the fan 44, generating a complete smaller bubble before the larger bubble is completed. When the trailing edge of the larger ring 76*b* eventually moves in front of the fan 44 to complete the generation of the larger bubble, the smaller bubble will have been completely generated, and it will be enclosed inside the larger bubble.

Figure 14:
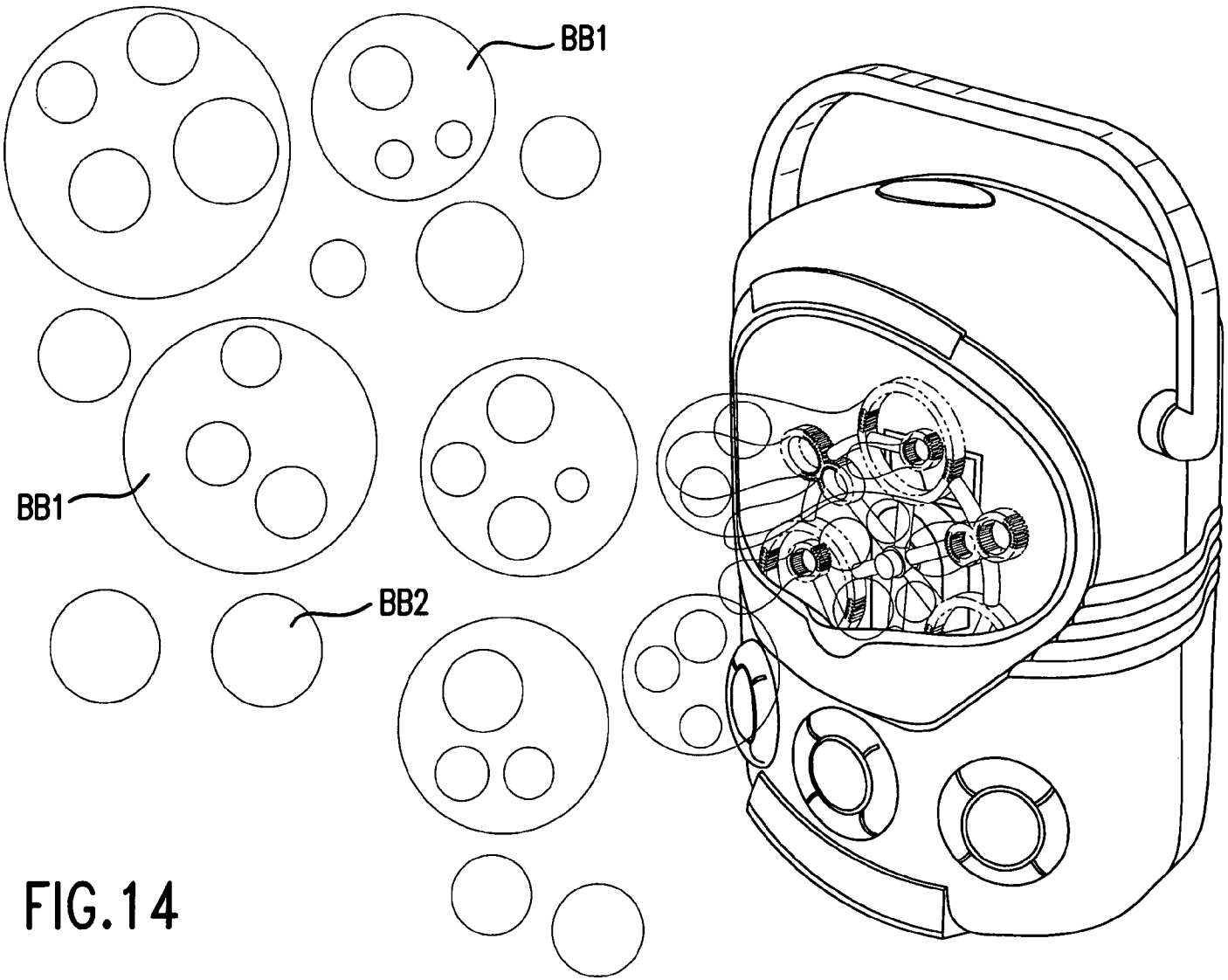
FIG. 14 is a perspective view of the bubble machine of FIG. 1 shown in use with the bubble generator of FIGS. 13A and 13B.

In addition, the provision of the sets of double bubble rings 76*b*+78*b* allows the machine 20 to produce two or more streams of continuous bubbles BB1 and BB2 (see FIG. 14). One stream BB1 will have smaller bubbles inside larger bubbles. The second stream BB2 of bubbles can have different sizes if the two rings of each set of double bubble rings 78*b* have different sizes.

When the user wishes to turn off the bubble machine 20, the user merely presses the switch 64 a second time. This opens the electrical circuit in the manner described above in connection with FIGS. 10 and 11A–11D, thereby cutting power to the motor 106. The fan 44 stops generating air, and the bubble generator 40 stops rotating, so that no further bubbles BB will be generated.

Thus, the present invention provides a bubble machine 20 where the air generator (i.e., fan 44) and the bubble generator 40 can be simultaneously actuated. The present invention also provides a bubble machine 20 that has a single button 64 that can function to turn the machine 20 on and off.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A bubble assembly, comprising:

a housing;

an air generator associated with the housing; and a bubble generator positioned in front of the air generator and comprising:

a loop defining a periphery;

a first bubble ring directly attached to a portion of the loop in a manner where part of the first bubble ring extends outside the periphery of the loop; and a second bubble ring directly attached to a portion of the loop and positioned inside the first bubble ring.

2. The assembly of claim 1, wherein the first and second bubble rings are positioned in the same plane.

3. The assembly of claim 1, wherein each bubble ring has a thickness and a cylindrical configuration.

4. The assembly of claim 1, wherein each bubble ring has a body with ridges provided thereon.

5. The assembly of claim 1, further including a third bubble ring directly attached to a portion of the loop in a manner where part of the third bubble ring extends outside the periphery of the loop, with the first and third bubble rings being spaced-apart from each other along the loop.

6. The assembly of claim 5, further including a fourth bubble ring directly attached to a portion of the loop and positioned inside the third bubble ring.

7. The assembly of claim 6, further including a fifth bubble ring directly attached to a portion of the loop in a manner where part of the fifth bubble ring extends outside the periphery of the loop, with the first, third and fifth bubble rings being spaced-apart from each other along the loop.

8. The assembly of claim 7, further including a sixth bubble ring directly attached to a portion of the loop in a manner where the sixth bubble ring extends inside the periphery of the loop adjacent the fifth bubble ring.

9. The assembly of claim 5, further including a fourth bubble ring directly attached to a portion of the loop in a manner where the fourth bubble ring extends inside the periphery of the loop adjacent the third bubble ring.

10. The assembly of claim 5, wherein the first, second and third bubble rings have different sizes.

11. The assembly of claim 5, wherein the first, second and third bubble rings have different shapes.

12. The assembly of claim 1, wherein part of the second bubble ring extends outside the periphery of the loop.

13. A bubble generator, comprising:

a loop defining a periphery;

a first bubble ring directly attached to a portion of the loop in a manner where part of the first bubble ring extends outside the periphery of the loop; and a second bubble ring directly attached to a portion of the loop and positioned inside the first bubble ring, where part of the second bubble ring extends outside the periphery of the loop;

wherein each bubble ring has a thickness and a cylindrical configuration.

14. The generator of claim 13, wherein the first and second bubble rings are positioned in the same plane.

15. The generator of claim 13, further including a third bubble ring directly attached to a portion of the loop in a manner where part of the third bubble ring extends outside the periphery of the loop, with the first and third bubble rings being spaced-apart from each other along the loop.

16. The generator of claim 15, further including a fourth bubble ring directly attached to a portion of the loop and positioned inside the third bubble ring.

17. The generator of claim 16, further including a fifth bubble ring directly attached to a portion of the loop in a manner where part of the fifth bubble ring extends outside the periphery of the loop, with the first, third and fifth bubble rings being spaced-apart from each other along the loop.

18. The generator of claim 17, further including a sixth bubble ring directly attached to a portion of the loop in a manner where the sixth bubble ring extends inside the periphery of the loop adjacent the fifth bubble ring.

19. The generator of claim 15, further including a fourth bubble ring directly attached to a portion of the loop in a manner where the fourth bubble ring extends inside the periphery of the loop adjacent the third bubble ring.

20. The generator of claim 15, wherein the first, second and third bubble rings have different sizes.

21. The generator of claim 15, wherein the first, second and third bubble rings have different shapes.

22. A bubble generator, comprising:

a loop defining a periphery;

a first bubble ring directly attached to a portion of the loop in a manner where part of the first bubble ring extends outside the periphery of the loop; and a second bubble ring directly attached to a portion of the loop and positioned inside the first bubble ring where part of the second bubble ring extends outside the periphery of the loop; and wherein each bubble ring has a body with ridges provided thereon.

* * * * *